US006009973A

United States Patent [19]

Woodyard

[11] Patent Number: 6,009,973

[45] Date of Patent: Jan. 4, 2000

[54] SLIDABLE ANCHOR POINT FIXTURE FOR RAILS

[75] Inventor: Clifford Woodyard, Auburn, Wash.

[73] Assignee: Guardian Metal Products, Inc., Auburn, Wash.

[21] Appl. No.: 08/964,357

[22] Filed: Nov. 4, 1997

[51] Int. Cl.[7] ..... A62B 35/00

[52] U.S. Cl. ..... 182/36; 248/228.4

[58] Field of Search ..... 182/36, 3, 45; 248/228.4, 230.4, 229.23, 229.13, 231.51, 316.5

[56] References Cited

U.S. PATENT DOCUMENTS

| | | | |
|---|---|---|---|
| 1,343,641 | 6/1920 | Patterson | 248/228.4 |
| 2,346,338 | 4/1944 | Sway . | |
| 2,456,987 | 12/1948 | Perkins | 248/316.5 |
| 2,708,557 | 5/1955 | Clark | 248/228.4 |
| 2,765,139 | 10/1956 | White . | |
| 4,606,430 | 8/1986 | Ruby | 182/36 |
| 4,767,091 | 8/1988 | Cuny | 182/3 |
| 4,799,639 | 1/1989 | Riley | 248/228.4 |
| 5,607,029 | 3/1997 | Beckman | 248/228.4 |

FOREIGN PATENT DOCUMENTS

| | | | |
|---|---|---|---|
| 648543 | 1/1951 | United Kingdom | 248/228.4 |
| 653683 | 5/1951 | United Kingdom | 248/228.4 |
| 1397075 | 6/1975 | United Kingdom | 248/228.4 |

*Primary Examiner*—Alvin Chin-Shue
*Attorney, Agent, or Firm*—David L. Tingey

[57] ABSTRACT

An anchor point fixture comprising 2 pivotably-joined opposing jaws form a rail slot between them adapted to receive a rail head with the rail passing between spaced-apart jaw lower portions, secured in a selective closed position to accommodate rails of differing cross section. The fixture is adjustable in size by means of a plurality of holes on a common arc on each upper portion of the opposing jaw, the holes spaced apart on a first jaw different that are the holes spaced apart on the second jaw to provide a wide range of finely adjustable close positions. A pin passes through a pair of aligned holes, one from each jaw. The jaw lower portions are massive to provide ballast and a center of gravity below the rail slot, and a D-ring for connecting a harness carabiner is affixed close above the rail slot, both to minimize binding as the fixture is pulled from the D-ring by a user. Slide plates also line the rail slot longitudinal with a beam placed within to maintain alignment of the fixture with the beam and to provide an increased sliding surface, also to minimize binding effects.

4 Claims, 3 Drawing Sheets

SLIDABLE ANCHOR POINT FIXTURE FOR RAILS

BACKGROUND

1. Field of the Invention

This invention relates to safety anchor points, fixtures that form an anchor point to which a person can attach himself by means of a rope or the like to safeguard against a possible fall. More specifically, this invention relates to an anchor point fixture slidably attachable to a rail such as a railroad rail or a crane rail, adjustable to accommodate a range of rail sizes.

2. Background

It is known to have anchor points to which a maintenance worker secures himself while moving about an elevated position. Government regulations require such persons to be safely secured to prevent injury due to an accidental fall.

It is previously known to have anchor point fixtures that slide along a train rail. Such fixtures comprise 2 halves that bolt together over and around a train rail and then slide along the rail when pulled. However, it is slow and cumbersome to connect and disconnect for a user moving off or on the rail. Thus, without a quick connection available, one might be tempted to not adequately connect himself to an anchor point for a brief excursion rather than undergo the tedious process bolting himself to the rail.

Rails vary considerably in cross sections depending on their design load. Train rails are rated at 135 lbs —the weight of a 3-foot section of the rail, intended to measure the cross section of the rail. A crane rail rating can vary from 40 lbs to 175 lbs. Generally, an anchor designed to attach around a rail is sized to match the rail rating, or cross section, so it does not accidentally come off the rail, for example, as when a large anchor were used on a small rail. It would be more economical and advantageous and would avoid the possibility of using an incorrectly-sized anchor fixture if a single anchor were adjustable to accommodate rails with various cross sections.

SUMMARY

It is a primary object of this invention to provide a slidable anchor point fixture specifically useful for sliding along either a railroad rail or a crane rail. It is another object that the fixture be quickly connectable and disconnectable to a rail. It is also an object that the fixture be adjustable to accommodate rails of different cross section. It is a further object that the fixture slide on the rail without binding.

These objectives are achieved in an anchor point fixture comprising 2 opposing "C"-shaped jaws pivotably joined at their upper portions forming a rail slot between them. Lower member portions are spaced apart when the fixture is its closed position such that a rail can pass between them as a rail head is received in the rail slot.

The jaws are fixed in a selective closed position by a pin passing through aligned holes in each jaw upper portion. So the jaws are adjustable to accommodate rails and rail heads of differing cross section, the fixture closed position is adjustable. The aligned holes comprise in each jaw upper portion a set of holes spaced apart on a common arc that traces the jaw pivoting action. To provide a wide range of fine adjustments, the holes on a first jaw are spaced apart a distance, typically ¼-inch, different than are the holes on the other jaw spaced apart, typically 3/16-inch.

A D-ring is attached just above the rail slot on the jaw upper portions, close to the rail slot to minimize binding from any moment that might be incurred in pulling on the D-ring where a carabiner (attaching a user's harness to the fixture) is typically attached. To further minimize binding, the jaw bottom portions are more massive than the upper portions such that the fixture center of gravity is below the rail slot therein providing needed ballast.

The fixture rail slot is lined with elongated slide plates intended to parallel a rail head in the rail slot to prevent the fixture from binding on the rail when the fixture is pulled along by a user.

DETAILED DESCRIPTION OF THE PRESENT INVENTION

Figure 1:
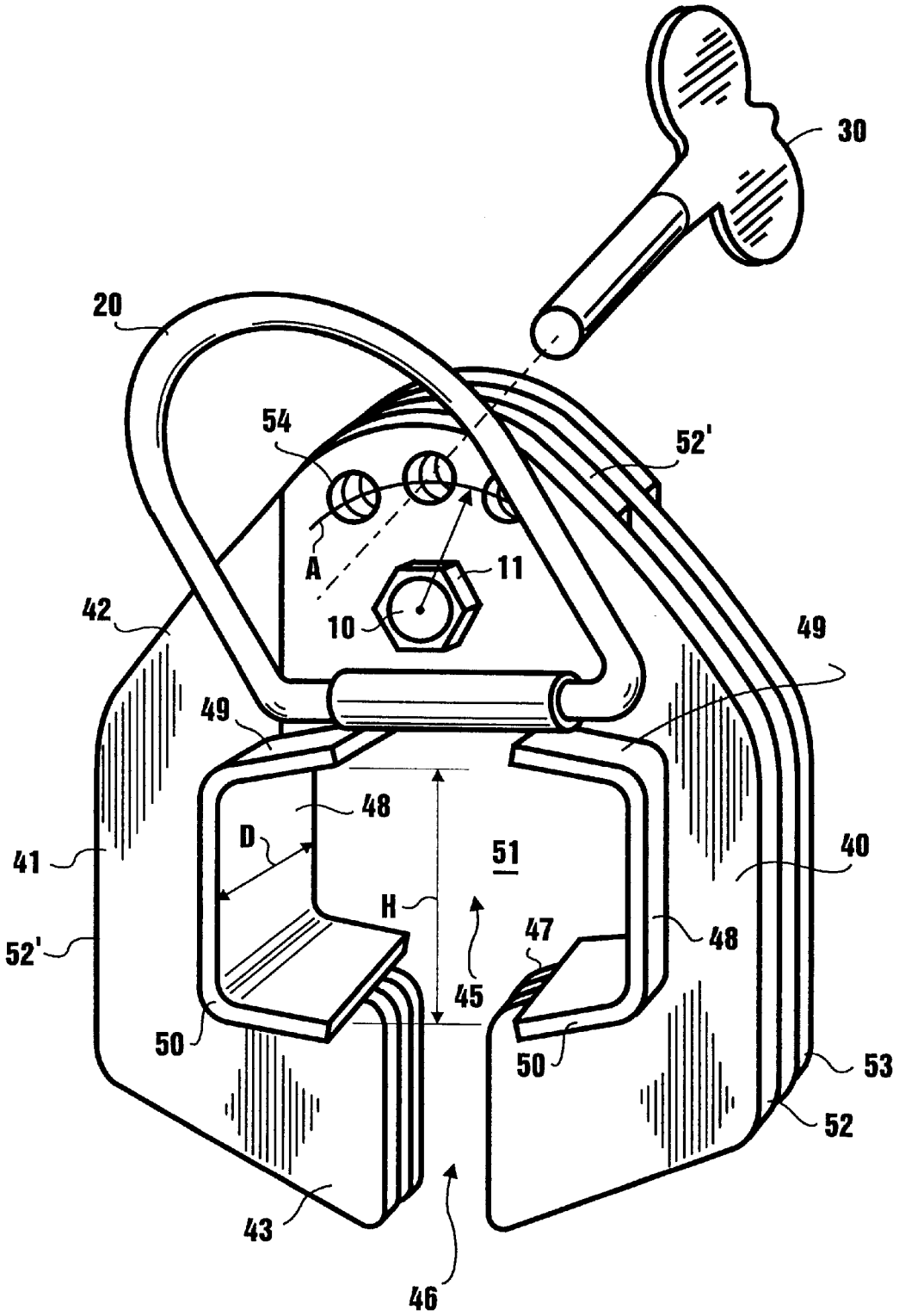
FIG. 1 is a perspective view of the anchor point fixture of the present invention.
Figure 2:
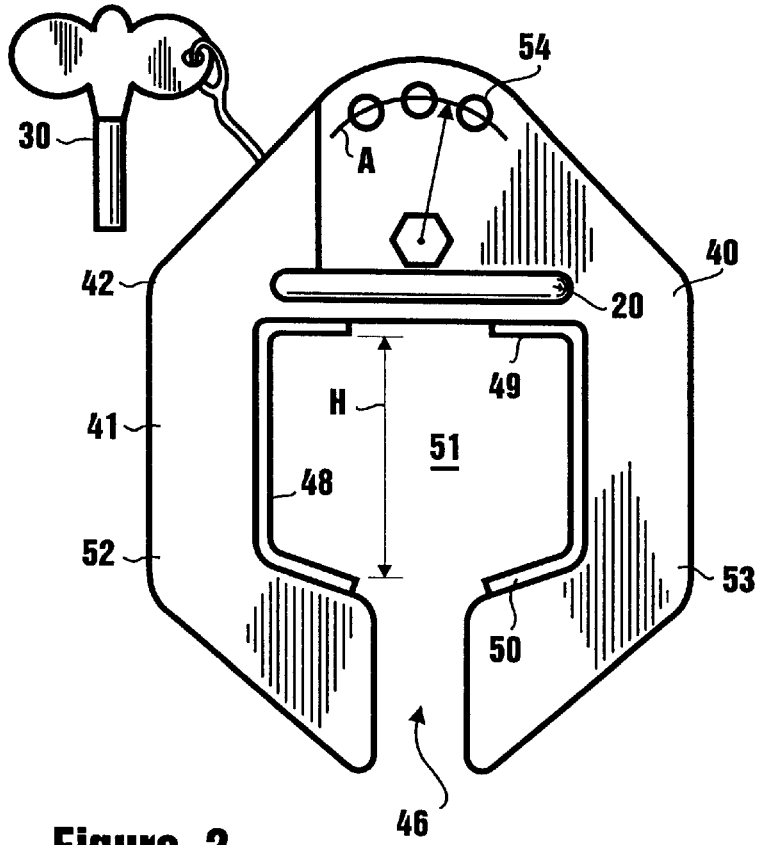
FIG. 2 is a front view of the anchor point fixture.
Figure 3:
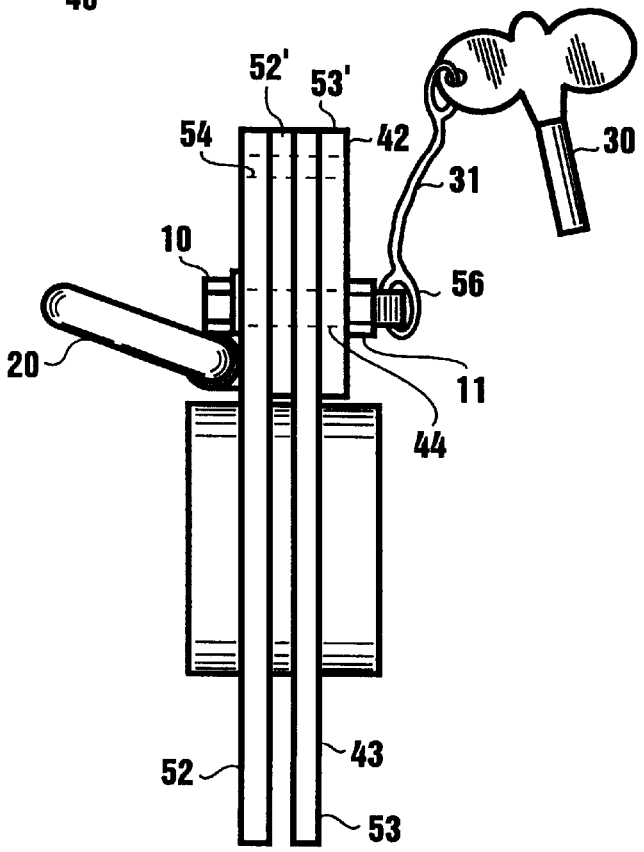
FIG. 3 shows the side view of the anchor point fixture of the present invention.

The anchor point fixture of the present invention comprises a pivot bolt 10 and matching threaded nut 11 threaded on the bolt 10, D-ring 20, locking pin 30 with lanyard 31, and first and second vertical jaw members 40 and 41 with upper and lower portions 42 and 43. Each jaw member has a bolt hole 44 in its upper portion 42 through which passes the pivot bolt 10 therein pivotably connecting the two jaw members at their upper portions in opposing disposition. The jaw members are C-shaped and reverse C-shaped, respectively, forming a rail slot 45 between them for receiving a rail 100, or more precisely, the rail head 101 extending transversely from the rail. The jaw member lower portions remain separated when the jaws are closed forming a channel 46 between the lower portions through which the rail 100 passes. Jaw member lower portions 43 extend under the rail slot 45 toward each other though spaced apart to form a slot bottom 47 so that a rail 100 in the slot 45 is prevented from passing out of the rail slot when the jaw members are closed. The member lower portions 43 are more massive than the member upper portions 42 such that the center of mass of the fixture is below the rail slot 45 to provide balast and so the fixture remains upright and slides on a rail in the rail slot without binding when pulled from a point above the rail slot 45.

The jaw members further comprise opposing elongated slide members with generally vertical side elements 48 defining the rail slot height, H, and also with top and bottom elements, 49 and 50, the side, the top element defining the generally horizontal rail slot top, and top and bottom elements fitting in the "C" shape jaw members. Each element extends longitudinally in defining a chute 51 with a depth, D, approximately equal to the height, H, which prevents the fixture on a rail from tipping fore or aft and facilitates nonbinding sliding through its extended sliding and support surface.

Each of the jaw members further comprise 2 parallel jaw member plates 52, 53 and 52', 53' spaced apart with one parallel plate 52' of each jaw member fitting slidably between the spaced-apart parallel plates 52, 53 of the other jaw member. That is, the fixture comprises interlaid, alternating plates of the 2 jaw members.

Figure 4:
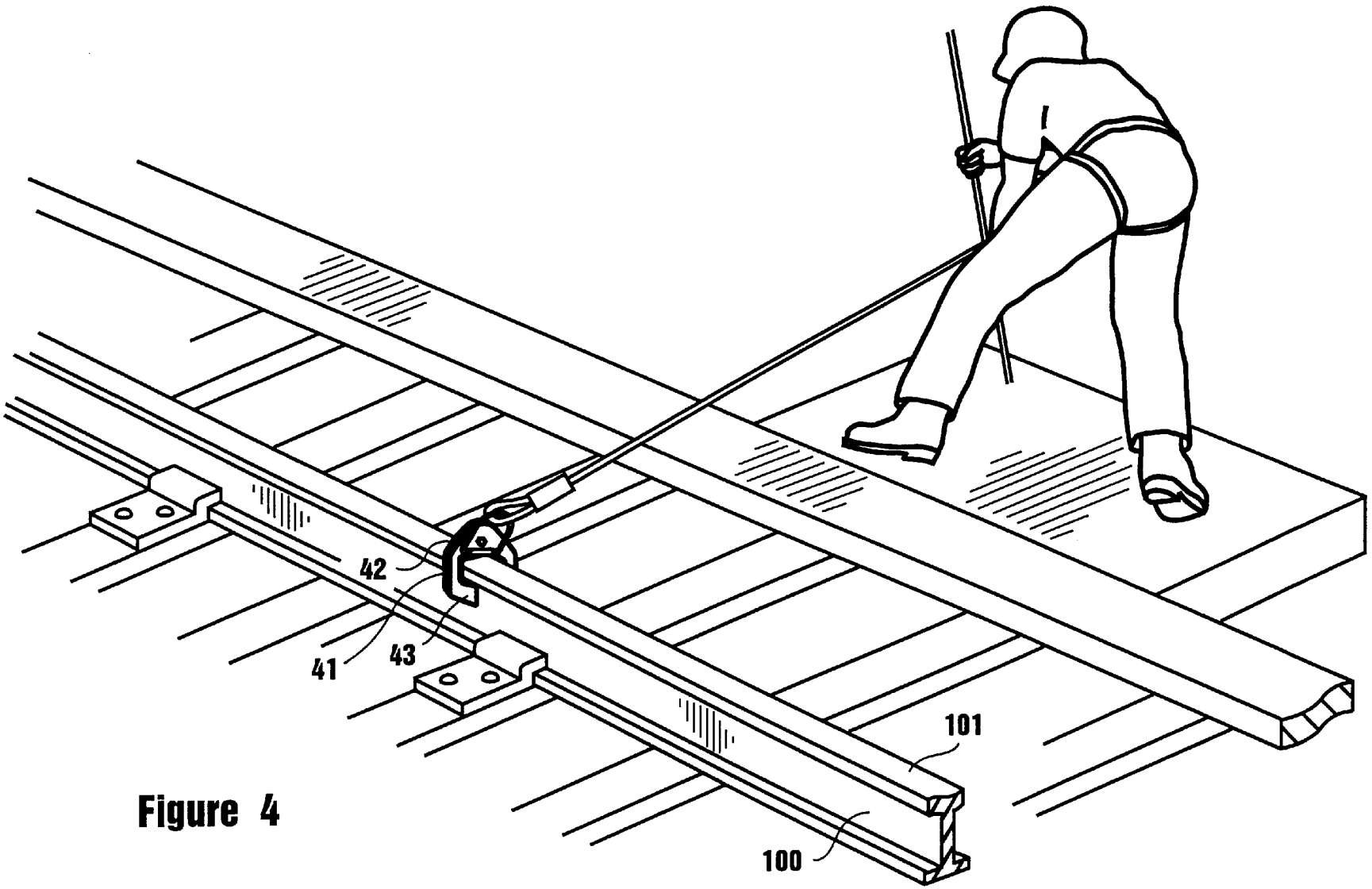
FIG. 4 shows the anchor point fixture in use about an overhead crane rail.

The D-ring 20, useful for attachment of a carabiner, is affixed to a jaw member face adjacent the rail slot 45 and slide member top element 49 to minimize a moment of force between the D-ring and the top elements 49 such that the fixture slides on a rail in the chute without binding when pulled from the D-ring. with a substantial horizontal component of force as shown in FIG. 4.

The jaw plates 40,41 are provided with a plurality of pin holes 54, typically 3, in the jaw plate upper portions. The holes are on a common arc, A, having the pivot bolt as the arc center so that when the jaws close, a pair of pin holes, one from each of the respective plates, move into alignment. To secure the jaw from pivoting open unintentionally, the locking pin 30 is removably inserted in the aligned holes.

The pin holes of one plate are spaced apart a first distance, typically ¼-inch, and the plurality of pin holes on the other jaw member are spaced apart on the arc a second distance different from the first, typically 3/16-inch, thereby presenting a large number of relative positions of the jaw members in which a pair of pin holes align. Thus, the jaws can be adjustable over a range of relative jaw member positions to receive rails of differing cross section in the chute. The lock pin is typically attached to one end of the lanyard 31 which is connected at its other end through a hole 55 in the pivot bolt 10 between the locking nut 11 and the bolt distal end 56 which prevents the nut from unthreading from the bolt.

I claim:

1. A slidable anchor point fixture comprising a pivot bolt, a ring, first and second opposing vertical jaw members, each with an upper portion and a lower portion, each jaw member upper portion having a bolt hole, the bolt holes aligned through which the pivot bolt passes pivotably joining the jaw members at jaw member upper portions with said first and second vertical jaw members pivotable on said pivot bolt, the jaw members together forming a rail slot, said upper portions having a substantially horizontal rail slot top surface that extends from a rail slot first side in the first jaw member entirely across the rail slot to a rail slot second side in the second jaw member, the rail slot being unobstructed to receive and slidably support a rail head on a rail, jaw member lower portions extending under the rail slot toward each other in spaced-apart relation to form a slot bottom adapted such that a rail received between the spaced-apart jaw member lower portions with its rail head in the rail slot is prevented from passing out of the rail slot when the jaw members are in a closed operative position around the rail head of a railroad rail loosely in slidable, nongripping disposition as a slidable safety anchor to which a railroad worker may be tethered to said ring by a harness line between the ring and the railroad worker, said anchor mounted to said railroad rail in said operative position such that as said tethered worker walks along said railroad rail, he pulls the anchor with him with a substantial horizontal component of force on the ring, a ring mount position disposed immediately adjacent the railroad rail whereby the anchor slides freely on the railroad rail without a binding moment between said ring mount position and said railroad rail as the railroad worker pulls on the ring and without said pulling on the ring causing the jaws to close together, the anchor thus sliding on the railroad rail without binding, and means to secure the pivotable jaw members in a selective position to prevent jaw members from unintentionally opening.

2. The slidable anchor point fixture of claim 1 in which the member lower portions extending below the rail slot comprise ballast members with sufficient mass such that the center of mass of the fixture is below the rail slot so the fixture remains upright in said operative position with the lower portions comprising the ballast members below the upper portions with the pivot pin and ring and thus tends to slide on a rail in the rail slot without binding when pulled by said railroad worker tethered to said ring.

3. The anchor point fixture of claim 1 further comprising opposing C-shaped slide members partially lining the opposing jaw members, respectively, 0for receiving said railroad rail head therebetween, facilitating sliding of the jaw members on said railroad rail head without binding.

4. A slidable anchor point fixture comprising a pivot bolt, first and second opposing vertical jaw members, each with an upper portion and a lower portion each jaw member upper portion having a bolt hole, the bolt holes aligned through which the pivot bolt passes pivotably joining the jaw members at jaw member upper portions with said first and second vertical jaw members pivotable on said pivot bolt, the jaw members, together forming a rail slot said upper portions having a substantially horizontal rail slot top surface that extends from a rail slot first side in the first jaw member entirely across the rail slot to a rail slot second side in the second jaw member, the rail slot being unobstructed to receive and slidably support a rail head on a rail, jaw member lower portions extending under the rail slot toward each other in spaced-apart relation to form a slot bottom adapted such that a rail received between the spaced-apart jaw member lower portions with its rail head in the rail slot is prevented from passing out of the rail slot when the jaw members are in closed operative position around the rail head of a railroad rail loosely in slidable, nongripping disposition as a slidable safety anchor to which a railroad worker may be tethered to said ring by a harness line between the ring and the railroad worker, said anchor mounted to said railroad rail in said operative position such that as said tethered worker walks along said railroad rail, he pulls the anchor with him with a substantial horizontal component of force on the ring, a ring mount position mounted on a rail top face immediately adjacent the rail top surface and hence the railroad rail whereby the anchor slides freely on the railroad rail without a binding moment between said ring mount position and said railroad rail as the railroad worker pulls on the ring and without said pulling on the ring causing the jaws to close together, the anchor thus sliding on the railroad rail without binding, and means to secure the pivotable jaw members in a selective position to prevent jaw members from unintentionally opening, wherein both of said jaw members includes a plurality of pin holes on a common arc with said plurality of pin holes on one of said jaw members spaced apart on the arc a first distance and said plurality of pin holes on the other of said jaw members spaced apart on the arc a second distance different from the first thereby presenting a large number of relative positions of the jaw members in which a selective pair of pin holes align therein providing a range of adjustment of the anchor point fixture over a range of relative jaw member positions adapted to receive rails of differing cross section in the chute and secures said jaws in said operative position in nongripping disposition, spaced apart loosely about said rail head enabling the anchor point fixture to slide on said railroad rail when pulled by a railroad worker.

* * * * *